US009200512B2

(12) United States Patent
Goodwin

(10) Patent No.: US 9,200,512 B2
(45) Date of Patent: Dec. 1, 2015

(54) FORMATION FLUID EVALUATION

(75) Inventor: Anthony R. H. Goodwin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1534 days.

(21) Appl. No.: 12/488,859

(22) Filed: Jun. 22, 2009

(65) Prior Publication Data

US 2010/0263862 A1 Oct. 21, 2010

Related U.S. Application Data

(60) Provisional application No. 61/169,491, filed on Apr. 15, 2009.

(51) Int. Cl.
*E21B 47/10* (2012.01)
*E21B 47/06* (2012.01)
*E21B 49/08* (2006.01)

(52) U.S. Cl.
CPC ..... *E21B 47/10* (2013.01); *E21B 47/06* (2013.01); *E21B 49/082* (2013.01)

(58) Field of Classification Search
CPC ... E21B 49/08; E21B 2049/085; G01N 9/002; G01N 2291/02818; G01N 29/036
USPC ..... 166/264; 73/32 A
See application file for complete search history.

(56) References Cited

U.S. PATENT DOCUMENTS

| | | | | |
|---|---|---|---|---|
| 5,230,254 | A * | 7/1993 | Craft | 73/861.355 |
| 5,901,788 | A * | 5/1999 | Brown et al. | 166/264 |
| 6,543,281 | B2 * | 4/2003 | Pelletier et al. | 73/152.47 |
| 7,114,562 | B2 | 10/2006 | Fisseler et al. | |
| 7,194,902 | B1 | 3/2007 | Goodwin et al. | |
| 7,222,671 | B2 | 5/2007 | Caudwell et al. | |
| 7,434,457 | B2 * | 10/2008 | Goodwin et al. | 73/152.46 |
| 2005/0028974 | A1 * | 2/2005 | Moody | 166/264 |
| 2009/0064693 | A1 * | 3/2009 | Matsiev et al. | 62/125 |

* cited by examiner

*Primary Examiner* — Blake Michener
*Assistant Examiner* — Kipp Wallace
(74) *Attorney, Agent, or Firm* — Kenneth L. Kincaid; Cathy Hewitt

(57) ABSTRACT

In-situ formation fluid evaluation methods and apparatus configured to measure a first resonance frequency of a first fluid using a first densimeter downhole, wherein a first density of the first fluid is known; measure a second resonance frequency of a second fluid using a second densimeter downhole, wherein the second fluid is a formation fluid received by the second densimeter downhole, and wherein a second density of the second fluid is unknown; and determine the second density of the second fluid using the first and second resonance frequencies and the known first density.

7 Claims, 12 Drawing Sheets

FORMATION FLUID EVALUATION

CROSS-REFERENCE TO RELATED REFERENCES

This application claims the benefit of U.S. Provisional Patent Application No. 61/169,491, entitled "FORMATION FLUID EVALUATION," filed Apr. 15, 2009, the disclosure of which is hereby incorporated herein by reference.

This disclosure is related to U.S. Pat. No. 7,194,902 to Goodwin, et al., entitled "APPARATUS AND METHOD FOR FORMATION EVALUATION," the disclosure of which is hereby incorporated herein by reference. This disclosure is also related to U.S. Pat. No. 7,222,671 to Caudwell, et al., entitled "APPARATUS AND METHOD FOR FORMATION EVALUATION," the disclosure of which is hereby incorporated herein by reference.

BACKGROUND OF THE DISCLOSURE

Tools exist for acquiring representative samples of reservoir hydrocarbon, such as the Modular Dynamics Tester™ of Schlumberger. These systems comprise probes, packers, and/or other means for connecting the internal mechanism of the tool with the formation. These systems also comprise pumps to extract reservoir fluid, fluid analysis devices to evaluate physical properties of the fluid including the quantity of mud filtrate, and fluid storage vessels to retrieve the fluid to surface. When these components are operated, they permit the acquisition of a sample representative of reservoir fluid with minimal contamination of filtrate that has invaded the reservoir pores close to the bore-hole wall. These fluid sampling systems contain tubulars that interconnect the probe/packer through often tortuous routes and valves containing restrictions. Ultimately, when the fluid analyzer indicates the mud contamination is sufficiently low, a sample is retrieved into bottles. Fluid sampling systems equipped with probes have been used with success in conventional oil and gas reservoirs, while dual packer systems have been used, for example, in formations of low-permeability.

Pumps within the sampling tools can operate with pressure differences between the formation and internal mechanisms of the tool of up to 7.5 kpsi. When the internal tool tubulars are filled with fluid of viscosity on the order of 1 cP at flow-rates of the order of 10 $cm^3/s$, the pressure drop that arises is negligible compared to 7.5 kpsi. In addition, conventional oil is typically located in consolidated formations, such that the formation neither collapses nor enters as solid granules into the sampling tool.

The density of a single phase fluid is one of the fundamental physical parameters required to describe fluid flow within the reservoir or borehole, as well as to determine both the properties of the surface facilities and the economic value of the fluid. Density is also required to provide the volume translation factor for cubic equations of state that are then often used for reservoir simulation. A measure of the single phase fluid density within the sampling tool provides a real-time in-situ determination of bore-hole fluid contamination, as well as economic value. Immiscible fluids are required, or a separator may be needed to provide the single phase fluid. Measurements with emulsions may be performed if the volume of each co-mingled phase is known before the density of the oil is extracted, and this can be achieved with, for example, coincidence gamma-ray attenuation measurements with a micro Curie source. For most applications, an expanded uncertainty in density of ±0.01 ρ is sufficient.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
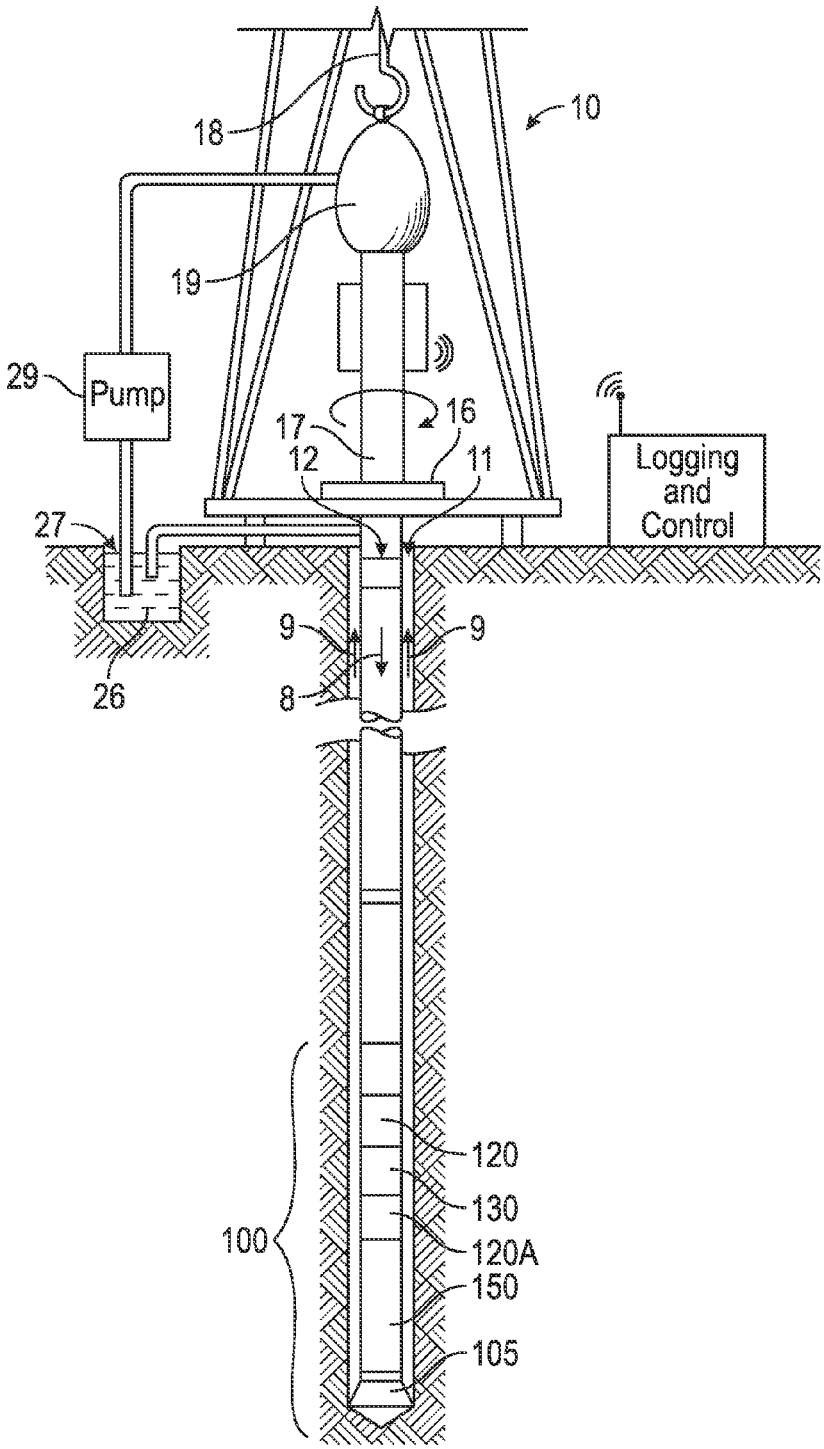
FIGS. 1A and 1B are schematic views of while-drilling apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1A is a wellsite system in which one or more aspects of the present disclosure can be employed. The wellsite can be onshore or offshore. In this exemplary system, a borehole 11 is formed in subsurface formations by rotary drilling in a manner that is well known. Embodiments of the present disclosure may also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment comprises a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module 120 includes a fluid sampling device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

Figure 1B:
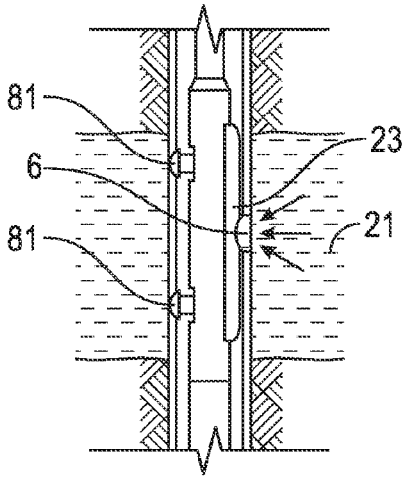

FIG. 1B is a simplified diagram of a sampling-while-drilling logging device of a type described in U.S. Pat. No. 7,114,562, incorporated herein by reference, utilized as the LWD tool 120 or part of an LWD tool suite 120A. The LWD tool 120 is provided with a probe 6 for establishing fluid communication with the formation and drawing the fluid 21 into the tool, as indicated by the arrows. The probe may be positioned in a stabilizer blade 23 of the LWD tool and extended therefrom to engage the borehole wall. The stabilizer blade 23 comprises one or more blades that are in contact with the borehole wall. Fluid drawn into the downhole tool using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the drilling tool and/or probe against the borehole wall. The LWD tool 120 also comprises means for measuring fluid density in-situ, as described below.

Figure 2:
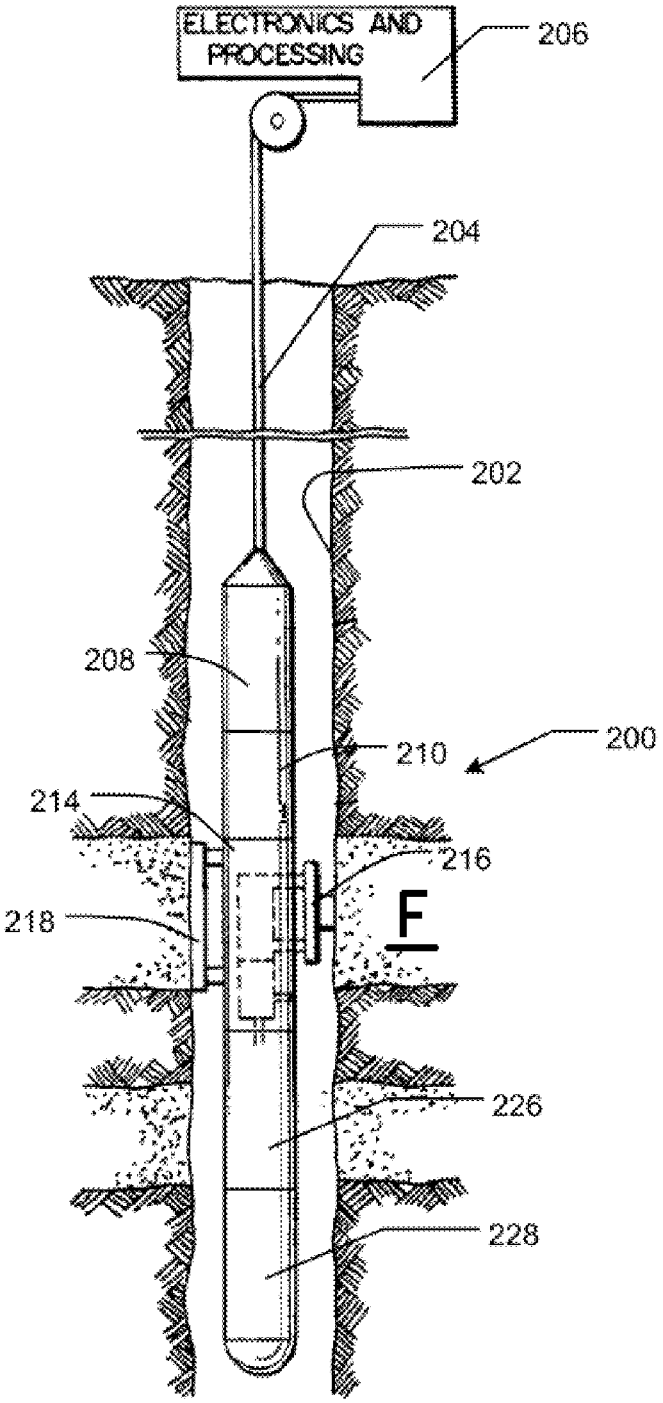
FIG. 2 is a schematic view of wireline apparatus according to one or more aspects of the present disclosure.

Referring to FIG. 2, shown is an example wireline tool 200 that may be another environment in which aspects of the present disclosure may be implemented. The example wireline tool 200 is suspended in a wellbore 202 from the lower end of a multiconductor cable 204 that is spooled on a winch (not shown) at the Earth's surface. At the surface, the cable 204 is communicatively coupled to an electronics and processing system 206.

The example wireline tool 200 includes an elongated body 208 that includes a formation tester 214 having a selectively extendable probe assembly 216 and a selectively extendable tool anchoring member 218 that are arranged on opposite sides of the elongated body 208. The extendable probe assembly 216 is configured to selectively seal off or isolate selected portions of the wall of the wellbore 202 to fluidly couple to the adjacent formation F and/or to draw fluid samples from the formation F. Accordingly, the extendable probe assembly 216 may be provided with a probe having an embedded plate. The formation fluid may be expelled through a port (not shown) or it may be sent to one or more fluid collecting chambers 226 and 228. In the illustrated example, the electronics and processing system 206 and/or a downhole control system are configured to control the extendable probe assembly 216 and/or the drawing of a fluid sample from the formation F.

Additional components (e.g., 210) may also be included in the tool 200. For example, the tool 200 also may also comprise means for measuring fluid density in-situ, as described below.

There are many methods that can be used to measure fluid density in a laboratory, including methods of determining fluid densities as well as absolute density standards. Of these, the methods that appear most appropriate for down-hole applications are those that do not rely on the knowledge of the orientation of the transducer with respect to the local gravitational field. Some of these methods are based on determining the resonance frequency of a vibrating object. There are many geometrical arrangements that have been reported for oscillating object densimeters, with the fluid contacting either the outer or inner surface of a (usually) metallic object. When the fluid is in contact with the outer surface, the measurement is usually considered intrusive when operated at elevated pressure, but when the fluid is inside a tube, the measurement is usually considered non-invasive. Once the particular device has been selected, a working equation must be developed to relate the measured quantity (e.g., frequency) to density, as well as to provide a measurement with an expanded uncertainty that is fit for purpose (k=2 or 95% confidence interval).

In view of the tubulars within a formation pressure tester, a good measure of density may be obtained through the use of a vibrating U-tube densimeter. The vibrating U-tubes offer advantages for wire-line (as well as other tool conveyance methods and LWD/MWD) in that they can be of low mass and can be well suited to sustaining mechanical shock, rapid changes in local acceleration, and the resultant application of large forces. Indeed, as the internal diameter of the tube decreases, so does the outer diameter, while still maintaining the ability to sustain a pressure difference across the tube from within. The type of material used to construct the tube and its elastic properties determine the absolute value of the pressure difference sustainable by a tube wall. The sensitivity of the measured frequency to the density of the fluid is proportional to the ratio of the mass of the tube to that of the fluid contained within, thus, it can be important to minimize the mass of the tube relative to that of the fluid while still maintaining mechanical integrity.

The U-tube may be either an existing tubular of the formation pressure tester or another internal side-branch or analysis system. Thus, the inner diameter and sample volume can vary, and affords another advantage of the U-tube densimeter. For example, a tube having an internal diameter of 1.2 mm, a length of 0.5 m, and bent into a U shape, has an internal volume of about $0.5\times10^{-6}$ $m^3$, which falls into a category of devices known as micro-fluidic. The bursting pressure may be estimated to be 70 MPa for a tube outer diameter of 1.65 mm. This possibility means U-tube densimeters can be used in situations where it is otherwise difficult to obtain large fluid volumes (e.g., greater than $0.5\times10^{-6}$ $m^3$) and thus permits in-situ operation in the reservoir hitherto impossible owing to the difficulty of obtaining greater volumes. These reservoir types include heavy oil, tight gas, and where ubiquitous water forms emulsions, because the measurement scheme can also be connected to a filtration of separation system.

Figure 3:
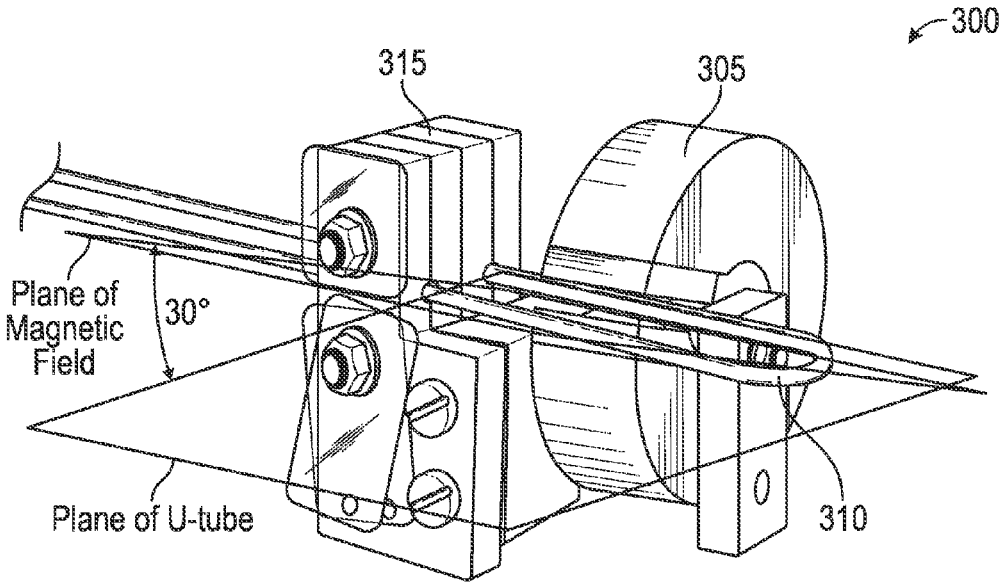
FIG. 3 is a perspective view of sensor apparatus according to one or more aspects of the present disclosure.

FIG. 3 is a perspective view of a known vibrating tube densimeter 300 having the magnetic field of the magnet 305 orientated at about 30 degrees to the plane of the tube 310 to preferentially excite both in-plane and out-of-plane resonances of the nearly doubly degenerate n=3 mode. The U-tube is held in a clamp 315 in an arrangement that ensures the electrical resistance between the clamped ends of the tube 310. This permits the measurement of motional EMF (electromotive force) generated by the application of an alternating current (AC), at frequencies close to that of the tube resonance, in the presence of the magnetic field (although other excitation and detection schemes have also been used). The magnetic field can be obtained from either permanent magnets or electromagnets, which can be attached directly to the oscillating tube with ceramic cement or a mechanical clamp.

Two vibrating tube devices which eliminate the requirement to use electromagnets and any appendages attached to the sensitive element of the densimeter tube have been reported in the literature. Eliminating the electromagnets removes the requirement that the clamp which holds the tube must have an electrical resistance much greater (about $10^4\Omega$) than the resistance of the tube over the U-length; the clamp electrically isolates the two ends and permits measurement of the motional emf. The first of these is a silicon based micro-electromechanical system (MEMS) reported by Enoksson, et al., and the second is a metallic tube and support described by Moldover and Chang. The MEMS device, although of the mm scale, had a variation of resonance with density of $f^1df/d\rho\approx-2\cdot10^{-4}$ $m^3\cdot kg^{-1}$ and uncertainty in density of about $0.01\cdot\rho$. The vibration of this tube was excited electrostatically with an electrode separated from the tube by 30 μm with a sine wave of amplitude 100 V AC. The tube motion was detected with a laser and a position sensitive photodetector. Although untested beyond ambient conditions, presumably this device could operate at elevated temperature with corrosive fluids but, owing to the two piece tube construction, would be unable to withstand elevated internal pressures without additional pressure compensation.

Figure 4A:
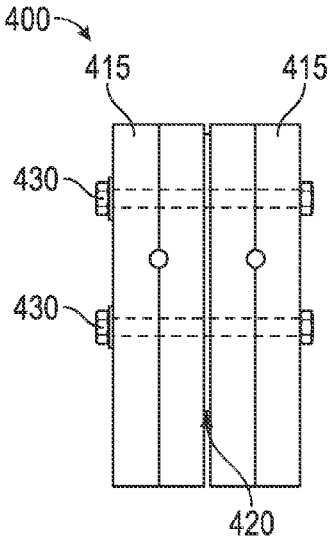
FIGS. 4A-4D are various view of the apparatus shown in FIG. 3.
Figure 4B:
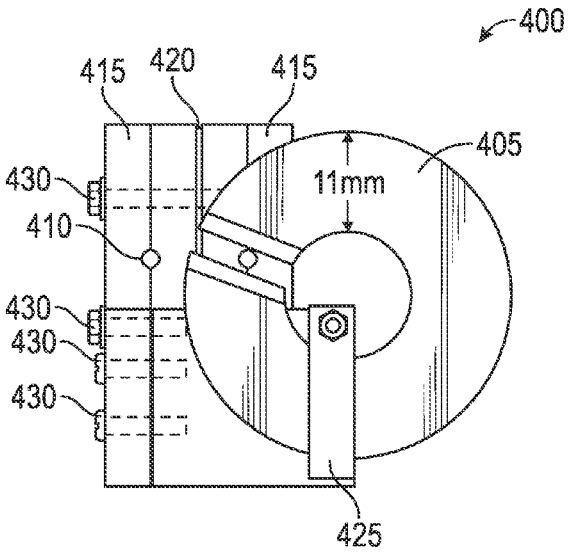
Figure 4C:
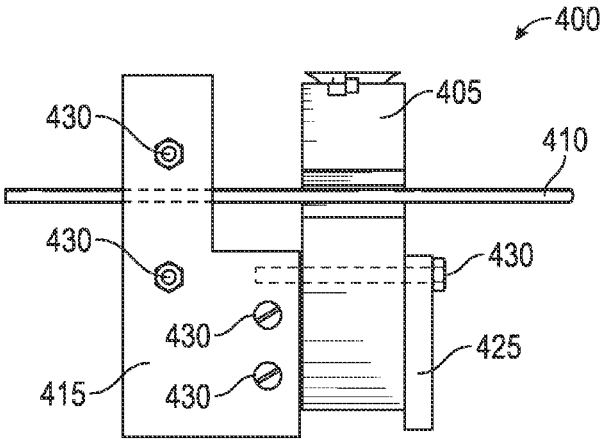
Figure 4D:
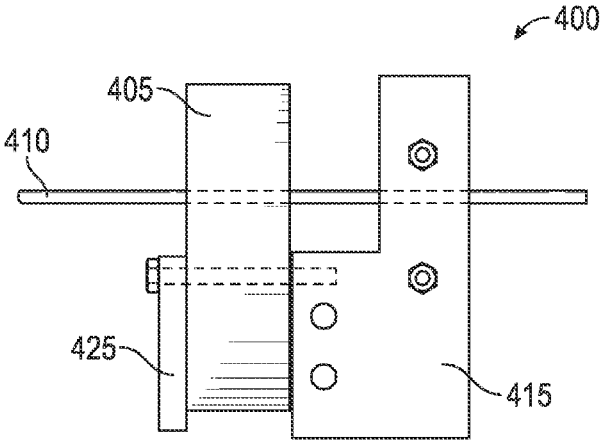

The second vibrating tube design, shown in FIGS. 4A-D as device 400, also eliminates electromagnets and appendages attached to tube of the densimeter, and can operate at elevated temperature. FIG. 4A is a rear view of the instrument showing tube clamps 415 and mica (or other) insulation 420 without the magnet 405, magnet clamp 425 or U-tube 410. FIG. 4B is a front view showing the magnet clamp 425. FIG. 4C is a left side view illustrating the clamping bolts 430. FIG. 4D is a right side view of the device as viewed from the front.

Measurements of the density of toluene, obtained with a device similar to that shown in FIG. 4, at temperatures between 298 K (where the density is about 900 $kg\cdot m^{-3}$) and 575 K (where the density is about 600 $kg\cdot m^{-3}$) at pressures below 13.8 MPa were reported. For this device, $f^1df/d\rho\approx-8\cdot10^{-5}$ $m^3\cdot kg^{-1}$, which is a factor of 3 lower than for Enoksson's MEMS device. The root mean square (RMS) deviation of densities obtained from the tube oscillation from literature was less than $0.001\cdot\rho$. Over a ten day period and at a temperature of 300 K, the resonance frequency of the evacuated tube was stable to better than $0.00025\cdot f$. Annealing the U-tube at a temperature above the range of operation resulted in a device with fractional stability in the resonance frequency of about $2\cdot10^{-6}$ $d^{-1}$ at a temperature of 575 K (equivalent to $0.025$ $m^3\cdot kg^{-1}\cdot d^{-1}$), while at lower temperatures the drift rate was less than $10^{-6}$ $d^{-1}$. This device meets the requirements for the thermal environment found in the oilfield. Dilation of the tube with pressure was determined by calibration with water. Vibrating U-tube densimeters have also been used to determine the density of fluids over a wide range of density, temperature and pressure, including measurements on aqueous electrolytes solutions.

For a vibrating tube densimeter having a straight tube clamped at both ends and filled with fluid and surrounded by either another fluid or vacuum, and assuming the fluid within the tube does not flow and thus the viscosity of the fluid is neglected, and further assuming that negligible internal damping exists, a working equation derived from the Navier-Stokes equations for a tube within vacuum reduces to:

$$\rho=K(T,p)/f^2+L(T,p) \tag{1}$$

This is the working equation routinely used for vibrating U-tubes. It is assumed that it applies even when the cross section is non-uniform and the tube is curved into a U-shape.

An alternative analysis provides an equation of functional form similar to Eq. 1. That is, Eq. 1 only applies when the outer surface of the tube is exposed to vacuum. However, if the tube is filled with liquid (or fluid at liquid densities), the tube can be immersed in a gas at a pressure of about 0.1 MPa. The magnitude of the pressure and temperature effect can be estimated for the tube shown in FIGS. 4A-D. A pressure difference of 100 MPa across the tube wall with p=0.1 MPa outside gives rise to a 0.3% increase of internal volume and thus a decrease in measured density, while a 200 K temperature increment results in volume increase of 0.96% and resulting underestimate of density. Eq. 1 assumes the restoring forces, which contribute to the oscillation, are in bending and shear of the tube. However, Eq. 1 has been applied successfully to both a curved tube, for which the eigenfrequencies are not easily calculated, and a tube of non-uniform cross-section.

The eigenfrequencies $f_n$ of a vibrating tube are then given by:

$$f_n = \frac{\pi\kappa}{2L^2}\left(\frac{Y}{\rho_t}\right)^{1/2}\beta_n^2 \tag{2}$$

where κ is the radius of gyration about the axis of the tube, Y is Young's modulus, $\rho_t$ is the tube's mass density, and $\beta_n$ are the eigenvalues: $\beta_1=1.5056$, $\beta_2=2.4997$, and $\beta_{n>2}\approx n+0.5$.

The sensitivity of a vibrating U-tube densimeter is, to first order, determined by the ratio between the mass of the tube and the fluid within it. Thus, decreasing the wall thickness by a factor increases the sensitivity by a factor of the same order. However, the working pressure for a tube, which is a fraction of the elastic limit, increases with increasing wall thickness, with an upper limit set by the material properties. A tube should be constructed from a material with high tensile and yield strengths.

Usually, the fluid density is determined from the frequency of the tube's n=1 mode given by Eq. 2. This places an additional constraint on the structure that holds the U-tube because it must recoil in response to the tube's motion. The tube resonance frequency is then coupled to the support and can give rise to an additional uncertainty in the measured frequency arising from the energy loss. Experiments have shown that the inertial effect is rendered insignificant when the support is of mass on the order of 1000 times greater than the tube because this reduces the effective mode coupling.

However, the n=3 mode has several potential advantages over the n=1 mode for small fast response densimeters. For a straight tube, the n=3 mode is doubly degenerate. For a slightly bent tube, the third mode is almost degenerate, with one component moving in-plane with lower frequency, and one out-of-plane with higher frequency. For a U-tube, the frequency difference between the two modes is on the order of 10 Hz, much larger than the resonance line width. For the n=3 mode, the straight portions of the U-tube bend toward and away from each other. To the extent that this motion is anti-symmetric, the center of mass does not move, the structure supporting the U does not recoil, and the sensitivity of the tube's resonance frequency to the support is reduced.

The location of the magnetic field relative to the tube plane determines which components of the mode are detected. At $\pi/4$ out-of-plane, both modes can be measured, while at $\pi/2$ only the in-plane motion can be observed, owing to the presence of a node. In addition, the higher frequency reduces the susceptibility of the device to low frequency environmental noise, which typically occurs at frequencies below 2 kHz. Other benefits of operating at higher n (and frequencies) with high Q resonances are the reduced settling time required between frequency changes and data acquisition that occurs when the resonance frequency of the tube is determined from measurements of the in-phase and quadrature voltages of the response at discrete frequencies over the resonance: a steady state measurement. At each step, the instrument waited about three times 1/(2g), where g, is the half the resonance line-width at $\frac{1}{2}^{1/2}$ of the maximum amplitude. The power dissipation in the tube was negligible and did not cause self-heating.

Another source of error arises from the assumptions of no internal damping and absence of fluid movement into and out of the tube that were used to obtain Eq. 1. Past experiments reported in the literature have shown the error arising from neglecting viscosity in the working equations by comparing the results obtained with the vibrating tube with values determined by other means, typically a pycnometer. One report considered fluids with viscosities in the range of 1 to $10^3$ mPa·s (with an Anton Paar DMA 02C densimeter). A second report studied fluids with viscosities between 1 and 40 mPa·s with a glass U-tube (Anton Paar model DMA 602), whereas a third study used metallic U-tubes at viscosities below 4 Pa·s. The second and third studies determined that the vibrating tube gave values greater than the pycnometer and provided empirical expressions as a function of viscosity to estimate the correction. Anton Paar recommends that, for a model 512P densimeter, the correction to density for fluid viscosity is given by:

$$\Delta\rho=\rho[-0.5+0.45(\eta/\text{mPa}\cdot\text{s})^{1/2}]\cdot 10^{-4} \tag{3}$$

and, subtracted from Eq. 1:

$$\rho=K(T,p)/f^2+L(T,p)-\Delta\rho(\eta)/\rho \tag{4}$$

For a vibrating tube filled with fluid of viscosity n≈76 mPa·s, Eq. 3 returns $10^2\Delta\rho/\rho=0.034\%$, while extrapolation of the expression reported in the first study by a viscosity of about 26 mPa·s gives $10^2\Delta\rho/\rho=0.044\%$, and that of the second study provides $10^2\Delta\rho/\rho=0.048\%$. The data in the third study suggest $10^2\Delta\rho/\rho$ increases linearly with increasing viscosity up to a viscosity of about 400 mPa·s where the uncertainty is about 0.09%; at higher viscosities, the uncertainty in density increases to about 0.1% at a viscosity of 4 Pa·s. However, it still remains a task for theoretical mechanics to explain these observations.

In view of this deficiency, a calibration is required to accommodate the above-described effects as well as those of the clamps, supports and the environment surrounding the tube. These differences, if unaccounted for, result in a systematic error in the observed density. If other departures from the model are assumed negligibly small contributions to the working equations, they can be ignored. It is then possible to conclude the effects arising from temperature and pressure variations might be adequately determined, for the purpose at hand, from knowledge of the elastic constants and thermal expansion of the material of construction combined with a room temperature determination of two parameters. This approach can only be proven by comparison of densities determined with the particular tube and this working equation with values determined from the archival literature from methods with quite different sources of systematic error.

The coefficients may be determined by calibration over the required temperature and pressure range. For example, in one previous study reported in the literature, the calibration coefficients were determined from resonance frequency measurements with the tube evacuated and when filled with water. The temperature and pressure range of the calibration measurements were the same as those required for the fluid of unknown density. For measurements at temperatures between 298 and 575 K at pressure below 13.8 MPa, a fourth order polynomial in temperature was required to represent one calibration parameter, while a third order polynomial in temperature was required for the other combined with a linear term for pressure. Over a greater pressure range, additional terms may be required to adequately accommodate the dilation of the tube with pressure. Pressure compensation, which will significantly reduce dilation, will result in an additional departure from the assumptions used to derive Eq. 1 as well as reduce the sensitivity of the instrument as defined by $df/d\rho$. It is also assumed that the supports, clamps and the bend in the tube are accommodated by the calibration parameters.

The parameters K and L may be determined by calibration measurements with at least two reference liquids of known density, such as water and nitrogen, or with one liquid of known density, for example, water, and with vacuum. Thus, the calibration may be performed with fluids that have $\eta<1$ mPa·s that may not be equivalent to the viscosity of the unknown. Thus, neglecting viscosity, Eq. 1 can be used to obtain Eq. 5:

$$\rho=K(T,p)/f^2+L(T,p)-\Delta\rho(\eta)/\rho \tag{5}$$

In general, the response of a vibrating object depends on either the ratio or quotient of density and viscosity. Instruments can be formed for which the parameter measured, for example resonant frequency, can be made more sensitive to one property or the other by choice of, for example, geometry. However, the working equations have assumed the properties are separable that is clearly an ideal case.

Another source of error arises from the fluid electrical conductivity that is in parallel with the tube conductivity. For operation with a highly conducting fluid, such as mercury, it might be necessary to alter the mechanical and electrical arrangement of the densimeter. However, provided the electrical resistance of the whole tube compared to that of the clamped U-section is large (at least a factor of the order of 100 greater), then the two ends of the tube can be shorted electrically at a fluid handling manifold without significantly reducing the signal.

The mechanical stability and the effect of electrically conducting fluid may be improved by removing both the insulating material in the support between the legs of the tube and bolts clamping the parts together. This can be achieved by inductively coupling the signals to and from the tube. In this case, both legs of the U-tube are attached, by welding when metal is used, to a metal plate that forms an electrically closed loop. The plate also holds two transformers; one couples the driving current into the loop, while the other detects the current circulating through the loop. This arrangement prevents operation with fluid other than air outside the tube. At resonance, the current is decreased by the motional EMF. To match the low impedance of the oscillator loop with the high impedance of synthesizer and detector, each transformer requires multiple turns on the winding placed around a ferrite toroidal core. In this case, the mica insulation used in the support is replaced by that used on the ferrite cores. The insulation is not subject to a compressive force. Indeed, the long-term stability of the transformers used to excite and detect the resonance only contribute to the circuit sensitivity, not the resonance frequency that determines density.

Figure 5:
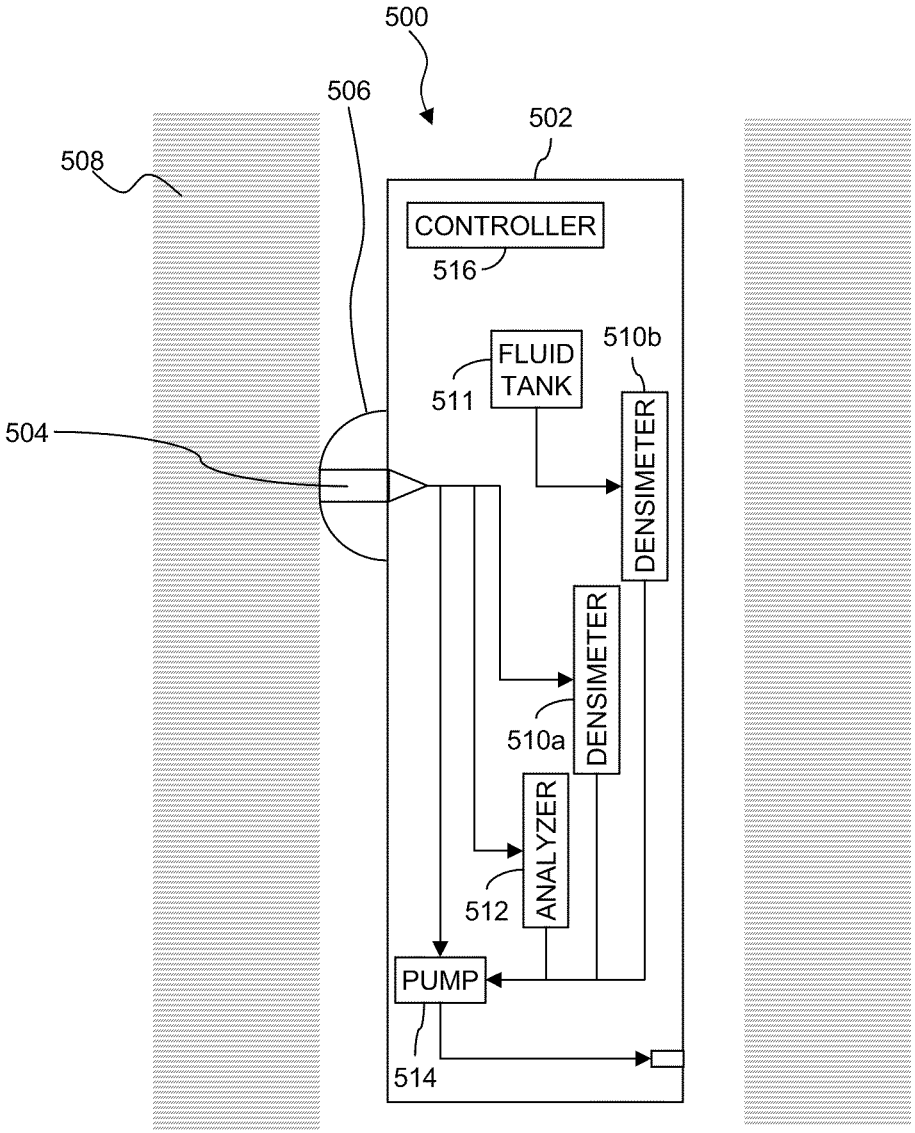
FIGS. 5-8 are schematic views of apparatus according to one or more aspects of the present disclosure.

In view of all of the above, the present disclosure introduces means for calibration and reduction of systematic errors, in the context of using a vibrating U-tube densimeter in a wireline or drillstring conveyed logging tool for down-hole fluid analysis. For example, FIG. 5 is a schematic view of a logging tool 500 comprising two essentially identical densimeters 510*a* and 510*b*, where one densimeter 510*b* is exposed to a fluid of known density and viscosity from an internal reservoir 511, and the other densimeter 510*a* is exposed to the unknown fluid via a sampling probe 504. The reference fluid in the tank 511 may be or comprise water, hydraulic oil, air and/or other fluids. Alternatively, the tank 511 may be substantially void of contents (e.g., vacuum).

The logging tool 500 may form at least a portion of one or more of the modules shown in FIGS. 1A, 1B and/or 2. Thus, for example, the logging tool 500 may include a housing 502 that contains the sampling probe 504 with a seal (e.g., packer) 506 that is used to acquire an aliquot of hydrocarbon from the formation 508. The hydrocarbon may be mobilized by a method such as heating and/or diluent injection, among others. As such hydrocarbon mobilization is well known in the art, the various components needed for such mobilization are not illustrated in the tool 500, but are nonetheless within the scope of the present disclosure. The logging tool 500 may also comprise a pump 514 configured to assist in the flow of sampled hydrocarbon within the tool 500. In this context, the logging tool 500 may further comprise a number of check, two-way, three-way, and/or other valves, as well as a controller 516 which may be in wired and/or wireless communication with the pump 514, valves, and/or other components of the logging tool 500 (although, for the sake of clarity, such valves and means of communication are not shown). For example, the controller 516 may at least partially operate the valves to direct the flow of sampled hydrocarbon from the probe 504 to various components of the logging tool 500.

As mentioned above, the logging tool 500 also comprises two essentially identical densimeters 510*a*, 510*b*. The densimeters 510*a*, 510*b* may each be substantially as described above and/or shown in FIGS. 3 and/or 4A-D, or otherwise within the scope of the present disclosure. In operation, the sample acquired from the formation 508 is directed from the probe 504 to the densimeter 510*a*, perhaps via operation of the pump 514. At or near the same time, a sample of a known fluid is directed from the fluid tank 511 to the densimeter 510*b*, perhaps via operation of the pump 514 and/or another pump within the tool 500. Operation of the densimeters 510*a*, 510*b* may be via the controller 516, other components of the logging tool 500, and/or surface equipment.

The logging tool 500 may also comprise an analyzer 512. The analyzer 512 may be configured to receive output data from the densimeters 510*a*, 510*b* to be utilized for further determination of the parameters of the sampled hydrocarbon. The analyzer 512 may also or alternatively be configured to perform its own analysis of the sampled hydrocarbon, such as in embodiments in which the analyzer is or comprises an optical fluid analyzer, spectrometer, chromatograph, and/or other analysis means. Operation of the analyzer 512 may be independent and/or at least partially controlled by the controller 516, other components of the logging tool 500, and/or surface equipment.

Such a vibrating U-tube densimeter tool may offer advantages for applications in wire-line and while-drilling applications that perform logging while drilling (LWD). This dual role arises from the relatively low tube mass and, thus, it is well suited to sustaining shock that imparts rapid and larges changes in local accelerations to the device and thus force. This means an in situ calibration is required.

The calibration procedure disclosed herein is particularly suited to down-hole fluid analysis because of the environment found down-hole. That is, in the absence of fluid flow, the down-hole temperature and pressure are constant relative to the variations in the transition to a down-hole depth.

The proposed procedure also eliminates the requirement to calibrate each tube prior to use and, in some circumstances, after use. The two tubes may be manufactured in the same process. During analysis and/or calibration, one tube is exposed to the unknown fluid and the other tube is filled with a fluid for which the density is known. Both tubes are exposed to a gas at the same pressure of about 0.1 MPa and at a pressure less than 1 MPa. The density of the unknown fluid is then determined from a ratio of the two measured frequencies for the two tubes, resulting in an equation of the form:

$$\rho(A) = \frac{\rho(R)\{K(A, T, p)/f^2(A) + L(A, T, p)\}}{\{K(R, T, p)/f^2(R) + L(R, T, p)\}} \tag{6}$$

where A refers to the unknown fluid and R refers to the reference fluid. Assuming, as may be achieved when the tubes are constructed from the same material source using the same procedure, K(R,T,p)=K(A,T,p) and L(R,T,p)=L(A,T,p), Eq. 6 reduces to:

$$\rho(A) = \frac{\rho(R)\{K/f^2(A) + L\}}{\{K/f^2(R) + L\}} \tag{7}$$

Thus, K and L can be determined for each tube at measurements with the fluid of known density at ambient pressure and temperature. Eq. 6 continuously accommodates the variation in the tubes in response to temperature and pressure, provided it is acceptable to assume the equality of the calibration parameters. For an idealized model, the parameter L is proportional to the ratio of the mass of the vibrating tube $M_t$ to the volume of fluid of unknown density V, and if K>>L, then Eq. 7 reduces to:

$$\rho(A) \approx \rho(R)\frac{f^2(A)}{f^2(R)} \tag{8}$$

Figure 6:
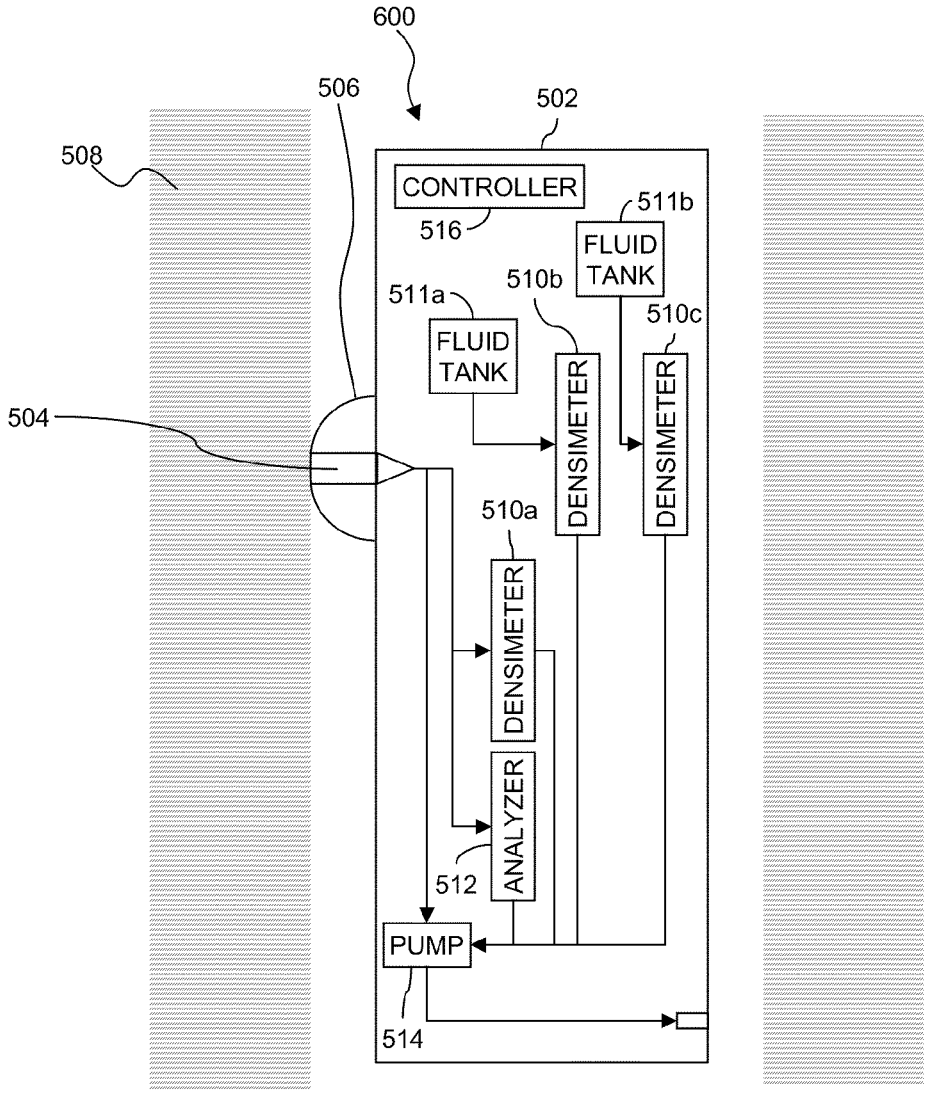

Alternatively, three tubes can be used. FIG. 6 is a schematic view of another embodiment of the logging tool 500 shown in FIG. 5, herein designated by reference numeral 600. The logging tool 600 may form at least a portion of one or more of the modules shown in FIGS. 1A, 1B and/or 2. The logging tool 600 shown in FIG. 6 may be substantially similar to the logging tool 500 shown in FIG. 5. However, the logging tool 600 comprises three densimeters 510*a*, 510*b* and 510*c*. In operation, one densimeter 510*a* is exposed to the sampled hydrocarbon, and the other two densimeters 510*b* and 510*c* are exposed to fluid of known thermophysical properties. Operation of the logging tool 600 may otherwise be similar to that of the logging tool 500 shown in FIG. 5.

In one embodiment utilizing such a configuration, densimeter 510*a* is exposed to the sampled hydrocarbon of unknown density, densimeter 510*b* is exposed to a fluid of known density, and densimeter 510*c* is filled with another fluid of known density. However, the density of the fluid in densimeter 510*b* is less than the unknown density of the sampled hydrocarbon (e.g., a vacuum), while the density of the fluid in densimeter 510*c* is greater than the unknown density of the sampled hydrocarbon (e.g., water). Thereafter, a series of equations similar to those described above in reference to FIG. 5 may be used to determine the density of the unknown fluid sampled from the formation 508.

Figure 7:
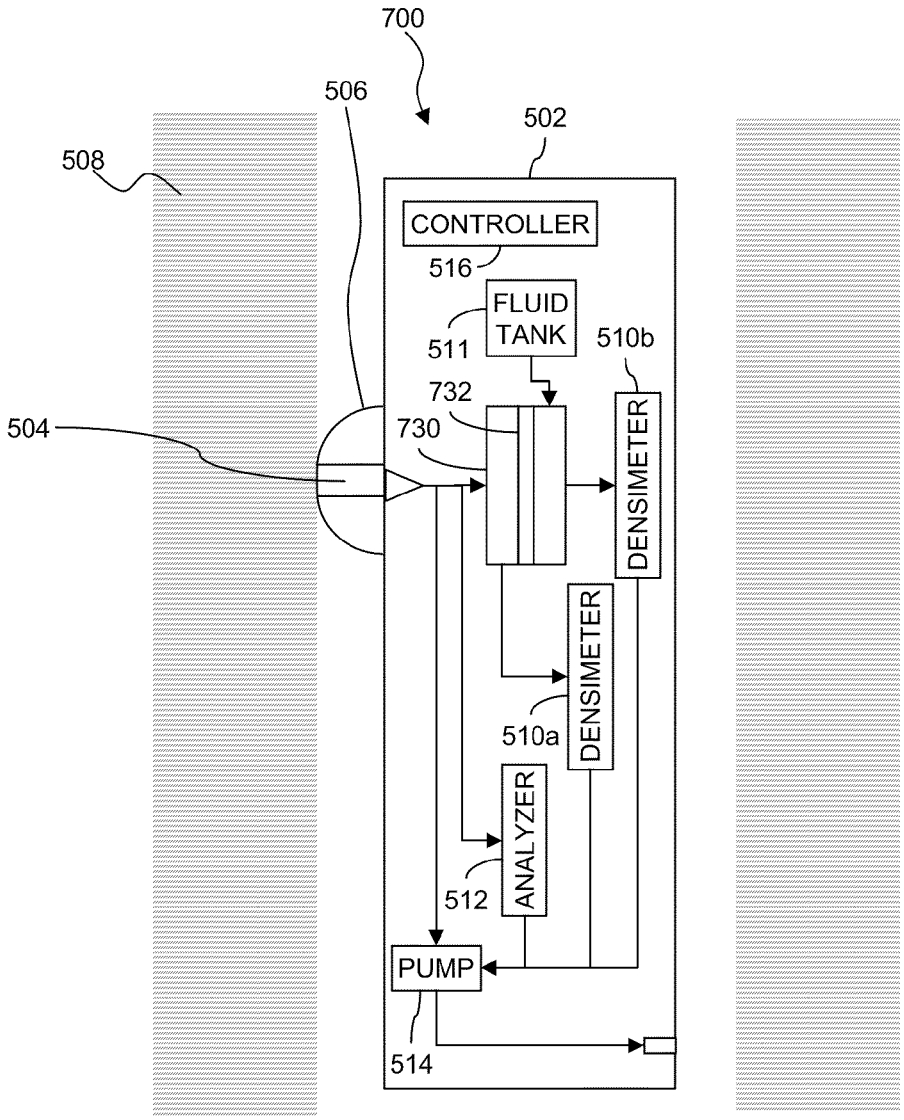

FIG. 7 is a schematic view of another embodiment of a logging tool 700 within the scope of the present disclosure. The logging tool 700 may form at least a portion of one or more of the modules shown in FIGS. 1A, 1B and/or 2. Aspects of the logging tool 700 shown in FIG. 7 may be used in conjunction with either of the tools 500 and 600 shown in FIGS. 5 and 6, respectively. However, for the sake of clarity, only the embodiment resembling tool 500 of FIG. 5 is shown in FIG. 7.

In addition to the components shown in FIGS. 5 and/or 6, the logging tool 700 comprises a bellows or piston-in-cylinder arrangement 730 configured to balance the pressure of the known fluid (in tank 511) and the unknown fluid (from probe 504). For example, the bellows 730 may comprise an internal cavity separated into two chambers by an internal member 732. The internal member 732 may comprise a piston, diaphragm, and/or other flexible or movable member configured to balance the pressure between the two chambers. In operation, the sampled hydrocarbon is directed from the probe 504 to one of the chambers and then to the densimeter 510*a*, whereas the known fluid is directed form the tank 511 to the other chamber and then to the densimeter 510*b*. Operation of the logging tool 700 may otherwise be similar to that of the logging tool 500 shown in FIG. 5.

Figure 8:
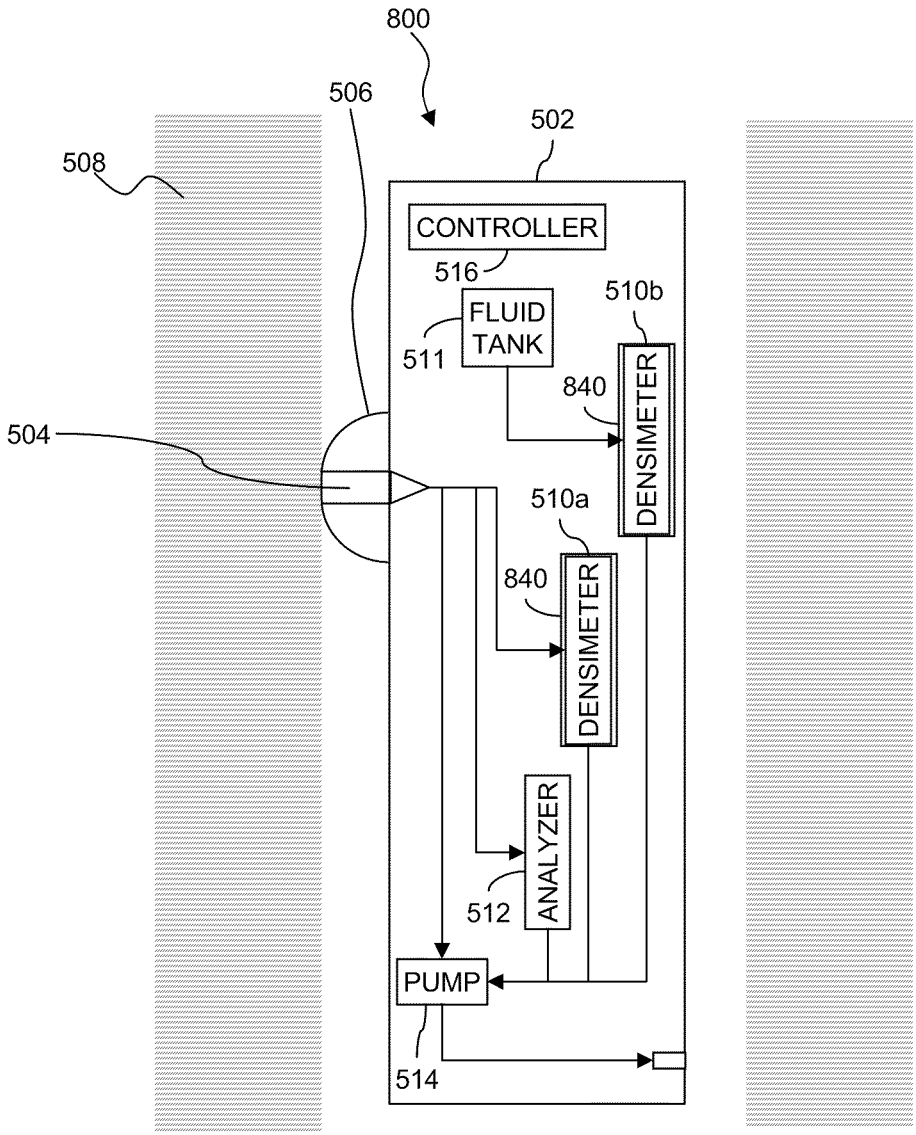

FIG. 8 is a schematic view of another embodiment of a logging tool 800 within the scope of the present disclosure. The logging tool 800 may form at least a portion of one or more of the modules shown in FIGS. 1A, 1B and/or 2. Aspects of the logging tool 800 shown in FIG. 8 may be used in conjunction with either of the tools 500, 600 and 700 shown in FIGS. 5, 6 and 7, respectively. However, for the sake of clarity, only the embodiment resembling tool 500 of FIG. 5 is shown in FIG. 8.

In addition to the components shown in FIGS. 5, 6 and/or 7, the logging tool 800 comprises two densimeters 510*a*, 510*b* which may or may not be identical. The logging tool 800 also comprises means for exposing both densimeters 510*a*, 510*b* to the same temperature during their analyses of the known and unknown fluids. For example, the logging tool 800 may comprise one or more heating elements 840 positioned adjacent or proximate one or more of the densimeters 510*a*, 510*b*. The heating elements 840 may each be or comprise a resistive heater, among other types, and may be controlled independently or by the controller 516. For example, the controller 516 may be configured to operate the heating elements 840 such that the temperature of the densimeters 510*a*, 510*b* are substantially the same during operation of the densimeters.

For oilfield operations, the temperature range is limited. Aspects of the tool 800 may allow performing a calibration at a temperature close to that required for operation. This may considerably reduce the number of calibration measurements.

Figure 9:
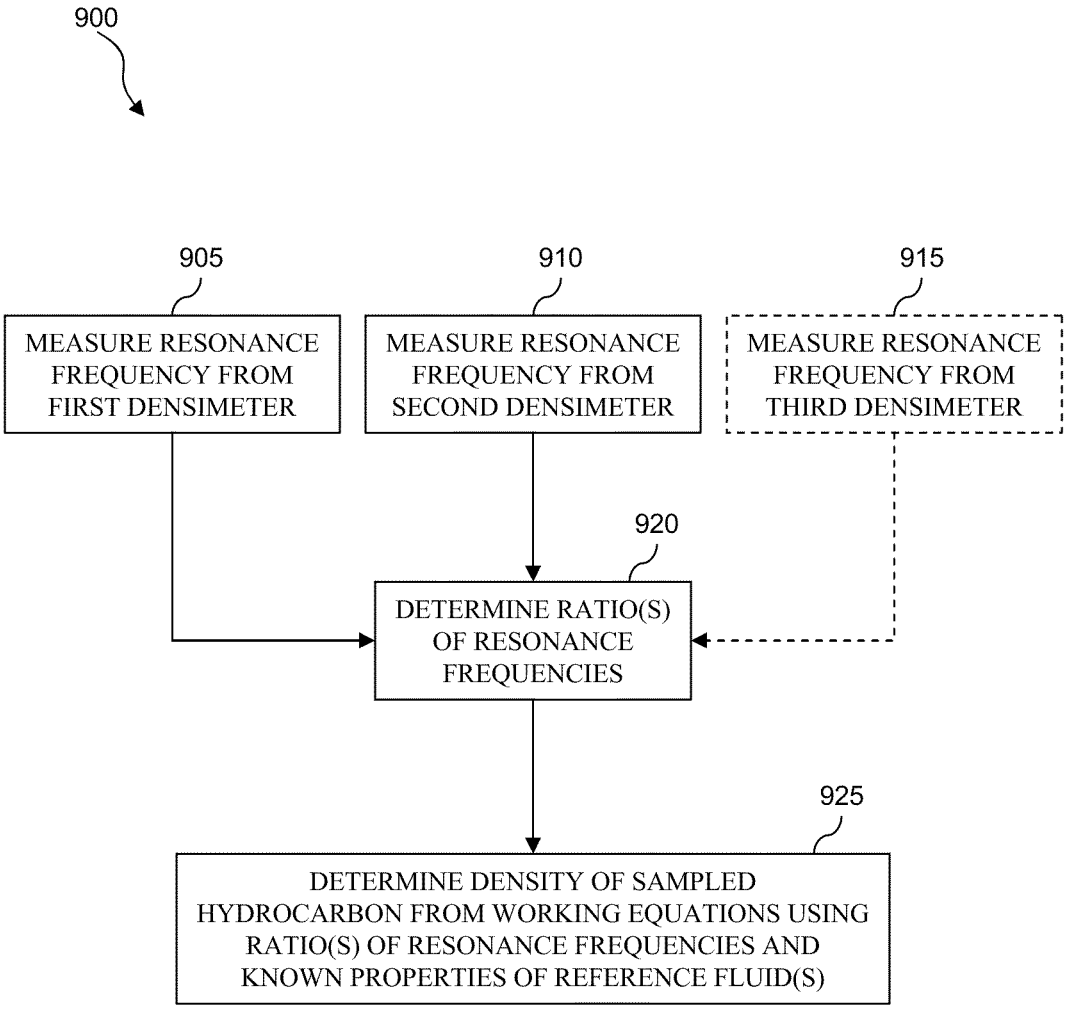
FIG. 9 is a flow-chart diagram of at least a portion of a method according to one or more aspects of the present disclosure.

FIG. 9 is a flow-chart diagram of a method 900 of obtaining downhole the density of sampled hydrocarbon using, for example, the logging tool 500 shown in FIG. 5, the logging tool 600 shown in FIG. 6, the logging tool 700 shown in FIG. 7, and/or the logging tool 800 shown in FIG. 8, among others within the scope of the present disclosure. The method 900 may also be performed via and/or within at least a portion of one or more of the modules shown in FIGS. 1A, 1B and/or 2.

In step 905, the resonance frequency of the vibrating U-tube of a first densimeter is measured. The first densimeter comprises the unknown fluid obtained from the formation. In step 910, the resonance frequency of the vibrating U-tube of a second densimeter is measured. The second densimeter comprises the known fluid obtained from, for example, an internal reservoir. In an optional step 915, the resonance frequency of the vibrating U-tube of an optional third densimeter may be measured. The third densimeter comprises a known fluid obtained from, for example, an internal reservoir, and may have a density greater than or less than the density of the known fluid in the second densimeter. Two or more of the steps 905, 910 and 915 may be performed substantially simultaneously.

A subsequent step 920 comprises determining the ratio(s) of the resonance frequencies that were determined during the previous steps. Thereafter, in step 925, the density of the sampled hydrocarbon is obtained from the working equations described herein, using the ratio(s) of resonance frequencies and the known thermophysical properties of the reference fluid(s).

Figure 10:
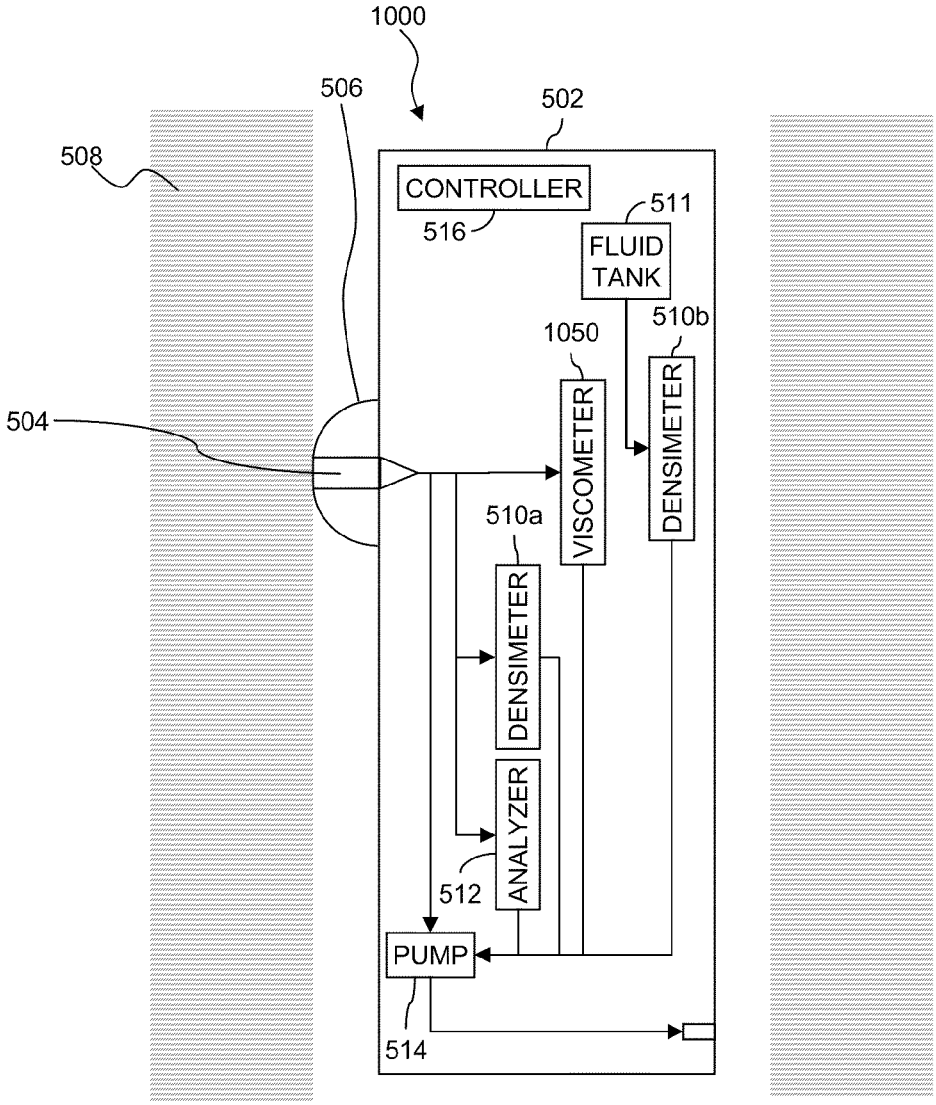
FIG. 10 is a schematic view of apparatus according to one or more aspects of the present disclosure.

FIG. 10 is a schematic view of another embodiment of a logging tool 1000 within the scope of the present disclosure. The logging tool 1000 may form at least a portion of one or more of the modules shown in FIGS. 1A, 1B and/or 2. Aspects of the logging tool 1000 shown in FIG. 10 may be used in conjunction with either of the tools 500, 600, 700 and 800 shown in FIGS. 5, 6, 7 and 8, respectively. However, for the sake of clarity, only the embodiment resembling tool 500 of FIG. 5 is shown in FIG. 10.

In addition to the components shown in FIGS. 5, 6, 7 and/or 8, the logging tool 1000 comprises a viscosity measuring device 1050. For example, the viscosity measuring device 1050 may be or comprise a vibrating wire viscometer. However, other viscosity measuring devices are also within the scope of the present disclosure. The viscosity measuring device 1050 may be positioned in the logging tool 1000 in place of one or more of the densimeters described above, or in addition thereto.

In operation, the viscosity measurement obtained by the viscosity measuring device 1050 may be used to make a correction to the density of the unknown fluid as determined using the densimeters 510*a* and 510*b*. This correction based on viscosity might be achieved by an empirical equation similar to Eq. 3. This requires an estimate of viscosity, such as that which might be obtained from measurements with a vibrating wire viscometer or capillary viscometer, among other methods and/or apparatus that may be used to determine viscosity within the scope of the present disclosure. If a vibrating object is used to provide viscosity, this will require an estimate of density, and thus the analyses will need to be iterated until the obtained values of density and viscosity vary fractionally by less than the estimated uncertainty in the measurement.

Figure 11:
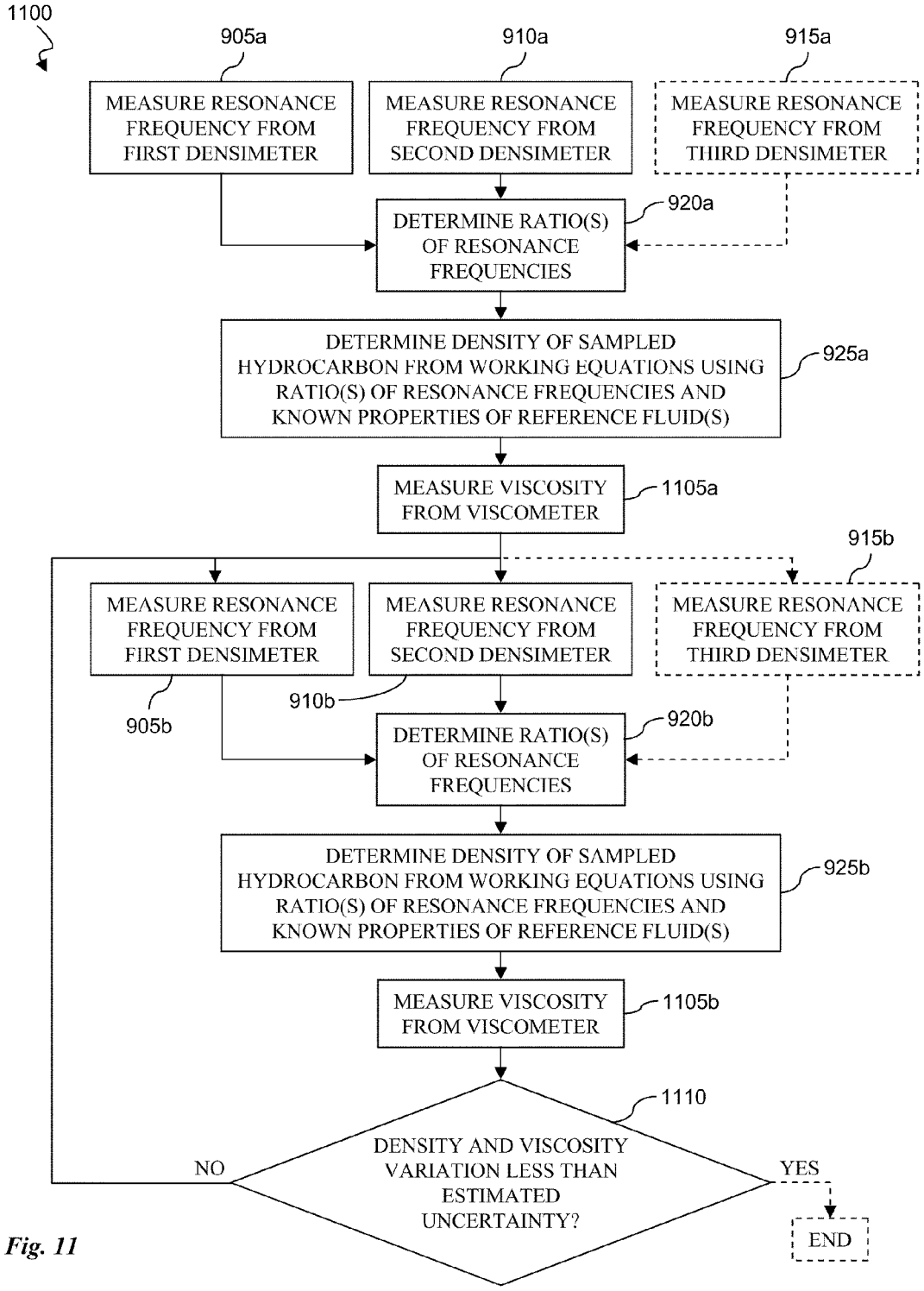
FIG. 11 is a flow-chart diagram of at least a portion of a method according to one or more aspects of the present disclosure.

For example, FIG. 11 is a flow-chart diagram of an iterative method 1100 for using the tool 1000 shown in FIG. 10. The method 1100 may be performed via and/or within at least a portion of one or more of the modules shown in FIGS. 1A, 1B and/or 2. For example, the method 1100 may be performed via and/or within the logging tool 500 shown in FIG. 5, the logging tool 600 shown in FIG. 6, the logging tool 700 shown in FIG. 7, and/or the logging tool 800 shown in FIG. 8, among others within the scope of the present disclosure. The method 1100 comprises iterations of the method 900 shown in FIG. 9, where each iteration includes the additional step of measuring the viscosity of the unknown fluid using the viscosity measuring device 1050 shown in FIG. 10.

In step 905*a*, the resonance frequency of the vibrating U-tube of a first densimeter is measured. The first densimeter comprises the unknown fluid obtained from the formation. In step 910*a*, the resonance frequency of the vibrating U-tube of a second densimeter is measured. The second densimeter comprises a known fluid obtained from, for example, an internal reservoir. In an optional step 915*a*, the resonance frequency of the vibrating U-tube of an optional third densimeter may be measured. The third densimeter comprises a known fluid obtained from, for example, an internal reservoir, and may have a density greater than or less than the density of the known fluid in the second densimeter. Two or more of the steps 905*a*, 910*a* and 915*a* may be performed substantially simultaneously. The method 1100 may also comprise only the step 905*a*, in which the lone densimeter measures the density of only the unknown fluid.

A subsequent step 920*a* comprises determining the ratio(s) of the resonance frequencies that were determined during the previous steps. Thereafter, in step 925*a*, the density of the sampled hydrocarbon is obtained from the working equations described herein, using the ratio(s) of resonance frequencies and the known thermophysical properties of the reference fluid(s).

In a subsequent step 1105*a*, the viscosity of the unknown fluid is measured using a vibrating wire viscometer and/or other viscosity measuring device. This step 1105*a* and the previous steps 905*a*, 910*a*, 915*a*, 920*a* and 925*a* are then performed a second time.

Thus, in step 905*b*, the resonance frequency of the vibrating U-tube of the first densimeter is measured. The first densimeter again comprises the unknown fluid obtained from the reservoir. In step 910*b*, the resonance frequency of the vibrating U-tube of the second densimeter is measured. The second densimeter again comprises the known fluid obtained from, for example, an internal reservoir. In an optional step 915*b*, the resonance frequency of the vibrating U-tube of the optional third densimeter may be measured. The third densimeter again comprises the known fluid obtained from, for example, an internal reservoir, possibly having a density greater than or less than the density of the known fluid in the second densimeter. Two or more of the steps 905*b*, 910*b* and 915*b* may be performed substantially simultaneously. The method 1100 may also comprise only the step 905*b*, in which the lone densimeter measures the density of only the unknown fluid.

A subsequent step 920*b* comprises once again determining the ratio(s) of the resonance frequencies that were determined during the immediately previous iteration of steps 905*b*, 910*b* and 915*b*. Thereafter, in step 925*b*, the density of the sampled hydrocarbon is recalculated from the working equations described herein, using the ratio(s) of resonance frequencies and the known thermophysical properties of the reference fluid(s).

In a subsequent step 1105*b*, the viscosity of the unknown fluid is again measured using the vibrating wire viscometer and/or other viscosity measuring device. During a subsequent decisional step 1110, it is determined whether the variation of the density and viscosity values of each of the two previous iterations of measurements is less than an estimated uncertainty. If not, then the method 1100 returns to steps 905*b*, 910*b* and 915*b* to perform another iteration. This continues until an acceptable level of variation is attained. Thereafter, the method 1100 may end or continue to other steps not described herein.

Figure 12:
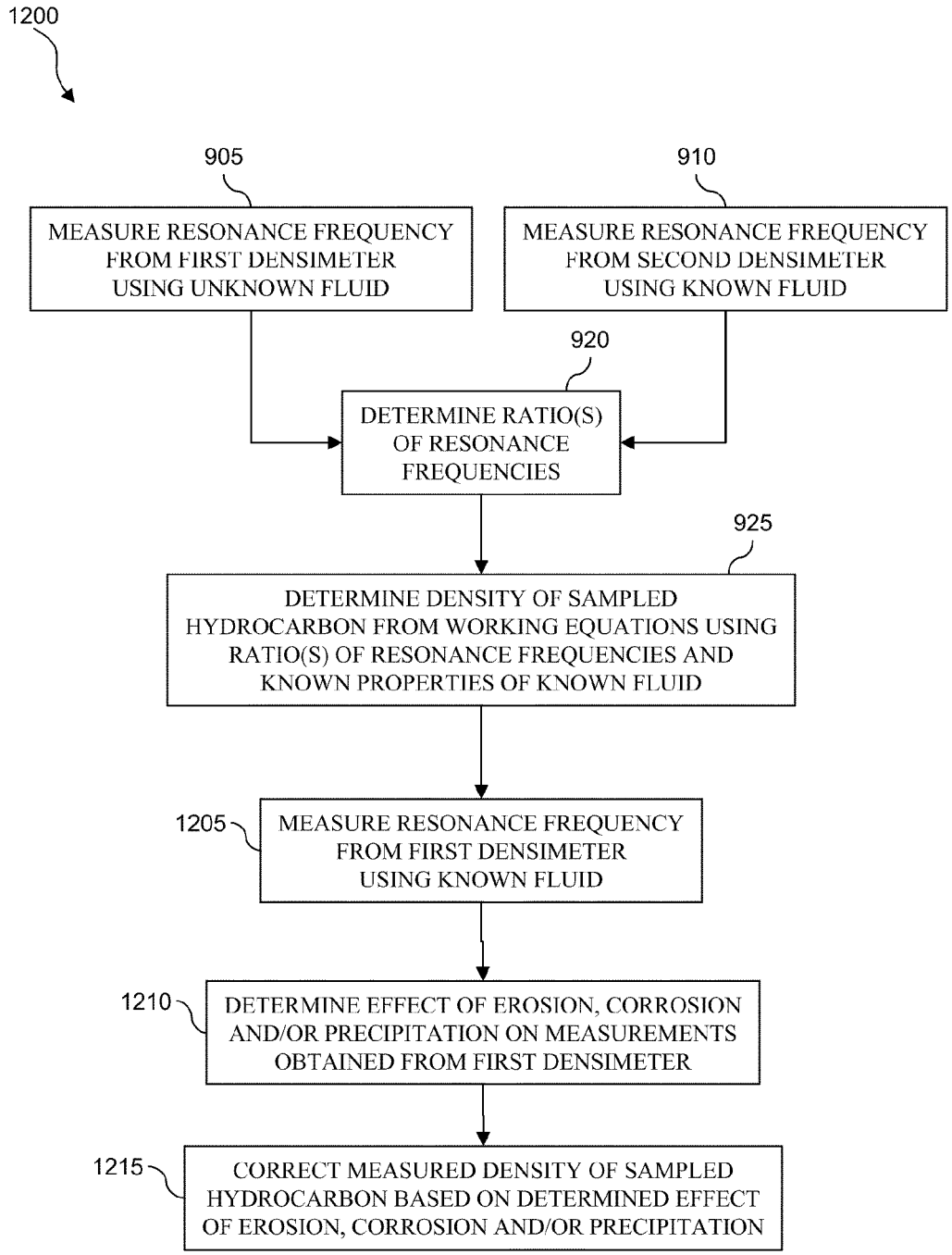
FIG. 12 is a flow-chart diagram of at least a portion of a method according to one or more aspects of the present disclosure.

FIG. 12 is a flow-chart diagram of a method 1200 of obtaining downhole the density of sampled hydrocarbon using, for example, the logging tool 500 shown in FIG. 5, the logging tool 600 shown in FIG. 6, the logging tool 700 shown in FIG. 7, the logging tool 800 shown in FIG. 8, and/or the logging tool 1000 shown in FIG. 10, among others within the scope of the present disclosure. The method 1200 may also be performed via and/or within at least a portion of one or more of the modules shown in FIGS. 1A, 1B and/or 2.

More specifically, the method 1200 may comprise determining erosion and/or corrosion of the U-tube wall and precipitation within or outside the U-tube, as these factors may also be employed to correct the density measurement obtained using a logging tool within the scope of the present disclosure. Generally, when two U-tubes are filled with a fluid of known thermophysical properties, the effect of erosion on the tube previously exposed to the unknown fluid can be determined. During operation, the U-tube exposed to fluids of unknown and known density can be exchanged to minimize the effect of erosion, corrosion and precipitation.

In step 905, the resonance frequency of the vibrating U-tube of a first densimeter is measured. The first densimeter comprises the unknown fluid obtained from the reservoir. In step 910, the resonance frequency of the vibrating U-tube of a second densimeter is measured. The second densimeter comprises the known fluid obtained from, for example, an internal reservoir. The steps 905 and 910 may be performed substantially simultaneously.

A subsequent step 920 comprises determining the ratio(s) of the resonance frequencies that were determined during the previous steps. Thereafter, in step 925, the density of the sampled hydrocarbon is obtained from the working equations described herein, using the ratio(s) of resonance frequencies and the known thermophysical properties of the reference fluid(s).

A subsequent step 1205 comprises again measuring the resonance frequency of the vibrating U-tube of the first densimeter, but this time the first densimeter comprises the known fluid instead of the unknown fluid. The method 1200 then proceeds to step 1210, during which the data obtained from the first densimeter with the unknown fluid during step 905 is used in conjunction with the data obtained from the first densimeter with the known fluid during step 1205 to determine what effect erosion, corrosion and/or precipitation may have had on the determination of the unknown fluid density. This information may then be employed during a subsequent step 1215 to correct the density of the unknown fluid obtained during step 925.

In each of the above-described embodiments, as well as other embodiments within the scope of the present disclosure, the coefficients K and L may be expressed in terms of the elastic constants and thermal expansion of the material used to form the U-tube. However, the U-tube is affected by the environment in which it is housed, as well as the mounting arrangement, which depends on the detection system to be used, as well as the properties of the fluid, if any, that surrounds the U-tube. Thus, additional calibration coefficients may be required to accommodate, for example, the clamping system. In situ acoustic measurement of the U-tube's mechanical constants may be used to provide data regarding the elastic constants, although doing so may require transducers that are attached to the U-tube and thus act as additional appendages and, more significantly, sources of potential systematic errors and variations in the U-tube's physical properties. This approach may provide a significant improvement in long-term stability for an instrument continually exposed to fluid and variations in temperature pressure, but without recourse to re-calibration. That is, it is suited to permanent sensing and not short-term, down-hole fluid analyses.

For oilfield operations, the U-tube may comprise a composition selected for high tensile strength and corrosion resistance, such as Hastelloy, Inconel and/or other alloys developed for production of hydrocarbons or pure metals such as titanium. However, other materials are also within the scope of the present disclosure.

In view of all of the above, it should be readily apparent to those skilled in the pertinent art that the present disclosure introduces a downhole logging tool comprising a reservoir containing a first fluid having a first density that is known, a first densimeter configured to receive the first fluid from the reservoir and output a first resonance frequency related to the first density, a second densimeter configured to receive a second fluid from a downhole formation proximate the logging tool and output a second resonance frequency related to a second density of the second fluid that is unknown, and an analyzer configured to determine downhole the second density based on the known first density, the first resonance frequency received from the first densimeter, and the second resonance frequency received from the second densimeter. Each of the first and second densimeters may comprise a vibrating tube densimeter. The first fluid having the known density may be selected from the group consisting of water, hydraulic oil and methylbenzene.

The reservoir may be a first reservoir, in which case the logging tool may further comprise a second reservoir containing a third fluid having a third density that is known, and a third densimeter configured to receive the third fluid from the second reservoir and output a third resonance frequency related to the third density, wherein the analyzer is configured to determine downhole the second density based on the known first density, the first resonance frequency received from the first densimeter, the second resonance frequency received from the second densimeter, and the third resonance frequency received from the third densimeter. The first density may be less than an estimated value of the second density, and the third density may be greater than the estimated value of the second density.

The downhole logging tool may further comprise a pressure balancing device configured to balance a first pressure of the first fluid and a second pressure of the second fluid. The pressure balancing device may comprise first and second chambers separated by a pressure balancing element, wherein the first chamber is fluidly connected between the reservoir and the first densimeter, and wherein the second chamber is fluidly connected between the formation and the second densimeter.

The downhole logging tool may further comprise a first heater (or cooler) configured to adjust a temperature of the first fluid when in the first densimeter, and a second heater (or cooler) configured to adjust a temperature of the second fluid when in the second densimeter.

The downhole logging tool may further comprise a viscometer configured to determine a viscosity of the second fluid. The viscometer may comprise a vibrating wire viscometer.

The present disclosure also introduces a method of in-situ formation fluid evaluation comprising measuring a first resonance frequency of a first fluid using a first densimeter downhole, wherein a first density of the first fluid is known, and measuring a second resonance frequency of a second fluid using a second densimeter downhole, wherein the second fluid is a formation fluid received by the second densimeter downhole, and wherein a second density of the second fluid is unknown. The method further comprises determining the second density of the second fluid using the first and second resonance frequencies and the known first density. Each of the first and second densimeters may comprise a vibrating tube densimeter. The first fluid may be selected from the group consisting of water, hydraulic oil and methylbenzene.

The method may further comprise measuring a third resonance frequency of a third fluid using a third densimeter downhole, wherein a third density of the third fluid is known, and wherein determining the second density of the second fluid comprises using the first, second and third resonance frequencies and the known first and third densities. The first density may be less than an estimated value of the second density, and the third density may be greater than the estimated value of the second density.

The method may further comprise balancing a first pressure of the first fluid and a second pressure of the second fluid. The method may further comprise heating at least one of the first and second fluids when in the first and second densimeters, respectively, so that temperatures of the first and second fluids are substantially equivalent during measuring of the first and second resonance frequencies.

The method may further comprise determining a viscosity of the second fluid.

The method may further comprise iteratively determining the viscosity and the second density of the second fluid until a variation of the determined viscosity and second density is less than an estimated uncertainty.

The method may further comprise measuring a third resonance frequency of the first fluid using the second densimeter to correct the determined second density of the second fluid based on whether erosion, corrosion or precipitation exists within the second densimeter.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method of in-situ formation fluid evaluation, comprising:

measuring a first resonance frequency of a first fluid using a first densimeter downhole, wherein a first density of the first fluid is known;

measuring a second resonance frequency of a second fluid using a second densimeter downhole, wherein the second fluid is a formation fluid received by the second densimeter downhole, and wherein a second density of the second fluid is unknown;

determining a viscosity of the second fluid;

determining the second density of the second fluid using the first and second resonance frequencies and the known first density; and iteratively determining a viscosity and the second density of the second fluid until a variation of the determined viscosity and the second density is less than an estimated uncertainty.

2. The method of claim 1 wherein each of the first and second densimeters comprises a vibrating tube densimeter.

3. The method of claim 1 wherein the first fluid is selected from the group consisting of water, hydraulic oil and methylbenzene.

4. The method of claim 1 further comprising measuring a third resonance frequency of a third fluid using a third densimeter downhole, wherein a third density of the third fluid is known, and wherein determining the second density of the second fluid comprises using the first, second and third resonance frequencies and the known first and third densities.

5. The method of claim 4 wherein the first density is less than an estimated value of the second density, and wherein the third density is greater than the estimated value of the second density.

6. The method of claim 1 further comprising balancing a first pressure of the first fluid and a second pressure of the second fluid.

7. The method of claim 1 further comprising measuring a third resonance frequency of the first fluid using the second densimeter to correct the determined second density of the second fluid based on whether erosion, corrosion or precipitation exists within the second densimeter.

* * * * *